US010231501B2

(12) United States Patent
Crocilla

(10) Patent No.: US 10,231,501 B2
(45) **Date of Patent: *Mar. 19, 2019**

(54) HAIR EXTENSIONS

(71) Applicant: Ultra Tips International Limited Incorporated, Knaresborough (GB)

(72) Inventor: Gaetano Giuseppe Crocilla, Cheltenham (AU)

(73) Assignee: Ultra Tips International Limited Incorporated (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/696,922

(22) Filed: Sep. 6, 2017

(65) Prior Publication Data

US 2017/0360134 A1 Dec. 21, 2017

Related U.S. Application Data

(63) Continuation of application No. 15/308,112, filed as application No. PCT/AU2015/000256 on May 1, 2015, now abandoned.

(30) Foreign Application Priority Data

May 2, 2014 (AU) ..... 2014901607

(51) Int. Cl.
*A41G 3/00* (2006.01)
*A41G 5/00* (2006.01)

(52) U.S. Cl.
CPC ..... *A41G 5/0066* (2013.01); *A41G 5/008* (2013.01); *A41G 5/0046* (2013.01)

(58) Field of Classification Search
CPC ..... A41G 5/00; A41G 5/0026; A41G 5/0033; A41G 5/004; A41G 5/0046; A41G 5/0053; A41G 5/0066
See application file for complete search history.

(56) References Cited

U.S. PATENT DOCUMENTS 5,868,145 A * 2/1999 Spann ..... A41G 5/008 132/201
9,241,524 B2 1/2016 Burchard
(Continued)

FOREIGN PATENT DOCUMENTS

AU 2007202472 * 5/2007
AU 2007202472 12/2008

OTHER PUBLICATIONS

International Search Report for PCT/AU2015/000256.

*Primary Examiner* — Rachel R Steitz
(74) *Attorney, Agent, or Firm* — Kegler, Brown, Hill & Ritter Co., LLP; Lorraine Hernandez

(57) ABSTRACT

The invention relates to a hair extension. In a preferred embodiment, the hair extension comprises strands that are attached together in such a way as to provide a substantially flat configuration, such that opposed sides are defined. This helps the hair extension to lay flat against a person's head. The opposed sides may have different hair colors on them, allowing flexibility and additional styling options. Preferably, the aligned hairs are compressed into a narrowed tip section, which is used to fasten the hair extension to a person's natural hair, using a deformable member such as a micro ring. A method of manufacturing the hair extension, and a method of attaching the hair extension to a subject, are also disclosed.

8 Claims, 7 Drawing Sheets

(56) References Cited

U.S. PATENT DOCUMENTS

| | | | | |
|---|---|---|---|---|
| 2004/0149302 | A1* | 8/2004 | Toda | A41G 5/0046 132/201 |
| 2011/0079233 | A1 | 4/2011 | Cheh | |
| 2011/0197908 | A1 | 8/2011 | Waters | |
| 2014/0338689 | A1 | 11/2014 | Shuttleworth | |
| 2015/0189936 | A1* | 7/2015 | Murphy | A41G 5/0046 132/201 |

* cited by examiner

HAIR EXTENSIONS

This application is a continuation application of and claims priority to U.S. patent application Ser. No. 15/308,112, filed on Nov. 1, 2016, which is the U.S. national phase of and claims priority to international application PCT/AU2015/000256, filed on May 1, 2015, which claims priority to Australian Patent Application No. 2014901607, filed on May 2, 2014, all are herein incorporated by reference.

FIELD OF THE INVENTION

This invention relates generally to a hair extension, a method for forming a hair extension, and a method for attaching a hair extension to a subject.

BACKGROUND OF THE INVENTION

Hair extension techniques can be used to extend the length or thickness of a person's hair, by attaching a hair extension composed of foreign hair (either artificial or natural) to the subject's own natural hair. Various techniques can be used for attaching the hair extension.

One attachment technique involves the use of 'micro rings'. In this technique, a hair extension is formed by gluing a plurality of foreign hair strands together at one end, using specially formulated glue. The glued end of the hair extension is the inserted into a metal 'micro ring', along with a section of the person's natural hair. The micro ring is then deformed using pliers or a similar clamping tool, to hold the hair extension to the section of the person's natural hair.

Other techniques for attaching the hair extension include gluing, taping or weaving the hair extension onto the subject's natural hair. However, each of these techniques has its own disadvantages.

One particular disadvantage common to several existing attachment techniques is that often, the hair extension will not sit naturally (or as naturally as desired) on the person's head. Another disadvantage is a lack of flexibility in the appearance of the hair extension when attached.

It would be desirable to provide a hair extension, and/or attachment technique for a hair extension, which addressed one or more of the above disadvantages, or at least provided an alternative to existing hair extensions and attachment techniques.

SUMMARY OF THE INVENTION

Accordingly, in a first aspect of the present invention, there is provided a hair extension comprising:

(a) a plurality of aligned hair strands attached together at an attachment end; and (b) a narrowed tip section formed from the hair strands at the attachment end, the tip section for fastening to a person's natural hair, wherein the hair strands are attached in a substantially flat configuration, such that a pair of opposed sides of the hair extension are defined.

The tip section may, in different embodiments, have different cross sections. However, preferably the tip section also has a substantially flat configuration.

The hair extensions may comprise hair strands of different colours, which may be attached such that each of the opposed sides has a different colour composition. This means that a different effect can be achieved, by attaching the hair extension with a different side facing outwards.

Preferably, the hair strands are adhered together at the attachment end using glue.

Preferably, the hair extension further comprises a shoulder defined between the tip section and a body of the hair extension. The shoulder can be formed by compressing or clamping the hair strands together to form the narrowed tip.

In a second aspect of the present invention, there is provided a method of extending a person's hair using a hair extension as described above, comprising fastening the tip section of the hair extension to a section of the person's natural hair.

The hair extension may be fastened with one of the opposed faces laying substantially flat against the person's scalp. This helps to put the hair extension close to the scalp to provide a more natural appearance.

The hair extension may be fastened to the person's hair by inserting the section of the person's natural hair, and the tip section of the hair extension, into a deformable member, and deforming the deformable member to clamp the tip section of the hair extension to the section of the person's natural hair.

In a third aspect of the present invention, there is provided a method of forming a hair extension, comprising:

(a) attaching a plurality of hair strands together at an attachment end; and (b) compressing the hair strands at the attachment end, to form a narrowed tip section for fastening to a person's natural hair.

The hair strands may be attached by adhering the hair strands together with glue. Depending on the type of glue used, there may be a delay between the step of adhering the hair strands together, and the step of compressing the hair strands at the attachment end, to allow the glue to dry to a desired state.

In a further aspect of the present invention, there is provided a kit for use in extending a person's hair, comprising:

(a) at least one hair extension as described above; and (b) at least one deformable member for fastening the hair extension to the person's hair.

In a further aspect of the present invention, there is provided a micro ring for use in fastening a hair extension to a person's natural hair, wherein the micro ring has a substantially flat cross section such that when in use, the micro ring lays substantially flat against the person's scalp.

The hair strands may be attached by gluing the hair strands together. Depending on the type of glue used, which is preferably a soft glue, there may be a delay of around 1 day to allow the glue to substantially dry, or dry to a desired state.

The hair strands may be attached in a substantially flat configuration, such that a width of the hair extension is greater than a thickness of the hair extension, and such that a pair of opposed sides of the hair extension are defined. The opposed sides may have different colour compositions.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

Various embodiments/aspects of the invention will now be described with reference to the following drawings in which.

DETAILED DESCRIPTION

Figure 1:
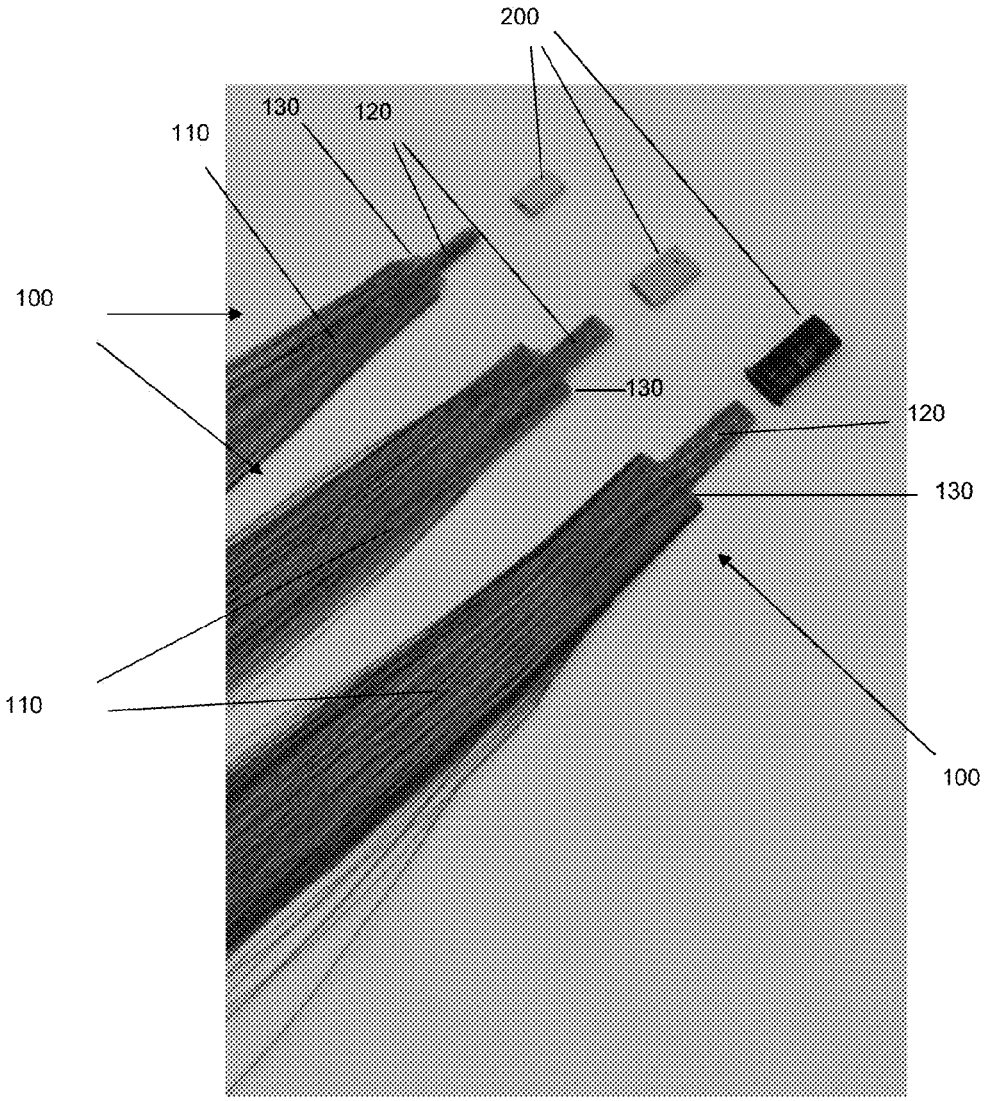
FIG. 1 depicts a kit comprising three hair extensions and three micro rings according to an embodiment of the present invention.

FIG. 1 depicts hair extensions 100 according to an embodiment of the present invention. Each hair extension 100 comprises a plurality of hair strands. The hair strands are aligned, extending along a body 110 of the hair extension 100, and attached together at one end. At that end, a narrowed, elongate tip section 120 can be seen in FIG. 1, with a shoulder 130 between the body 110 and the tip section 120.

Micro rings 200 can be used, as deformable members, to attach the hair extensions 100 to a person's natural hair, by inserting both the tip section 120 of the hair extension 100 and a section of the person's natural hair into a micro ring 200. The micro ring 200 can then be deformed, for instance using a pair of pliers or other clamping tool, to clamp the tip section 120 and the person's natural hair together.

The exact shape of the hair extension 100 may vary in different embodiments. However, in the embodiment shown in FIG. 1, the body 110 of the hair extension 100 is substantially flat, with a width greater than its thickness, and defining a pair of opposed sides—a top side that can be seen in FIG. 1, and a bottom side that is hidden from view. Of course, it will be understood that, if turned over, the opposite side of the hair extension 100 would be visible.

The use of a substantially flat hair extension allows for various advantages over conventional hair extensions. Firstly, a substantially flat hair extension can sit closer and flatter against the person's scalp, which will generally provide a more natural appearance compared to conventional hair extensions.

Secondly, since the hair extension of FIG. 1 is flatter and wider than conventional hair extensions, it allows fewer hair extensions to be used to provide a more even coverage across an area of a person's head.

Thirdly, the hair extension of FIG. 1 enables a wider range of effects, depending on the wishes of the subject. For instance, in the embodiment shown in FIGS. 1 to 3, the opposed sides of the hair extension may have different colour compositions. This allows each hair extension to be attached with a different side facing outwards, and so with a different colour displayed.

Figure 2:
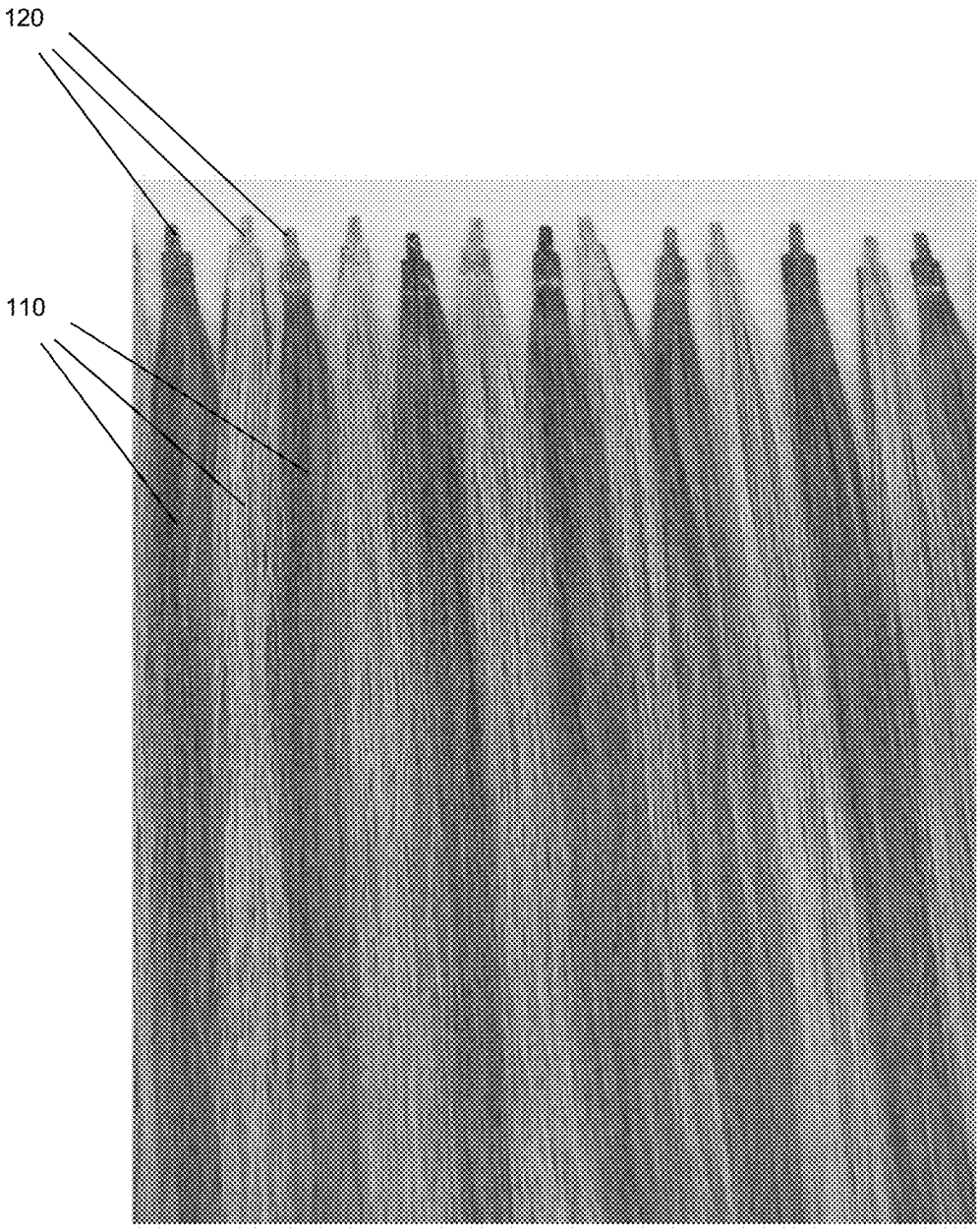
FIG. 2 depicts a plurality of hair extensions according to an embodiment of the present invention.

More specifically, FIG. 2 depicts a number of hair extensions 100, arranged in line. The hair extensions 100 are arranged with an alternating sequence of lighter and darker colours, to give a highlighted effect.

Figure 3:
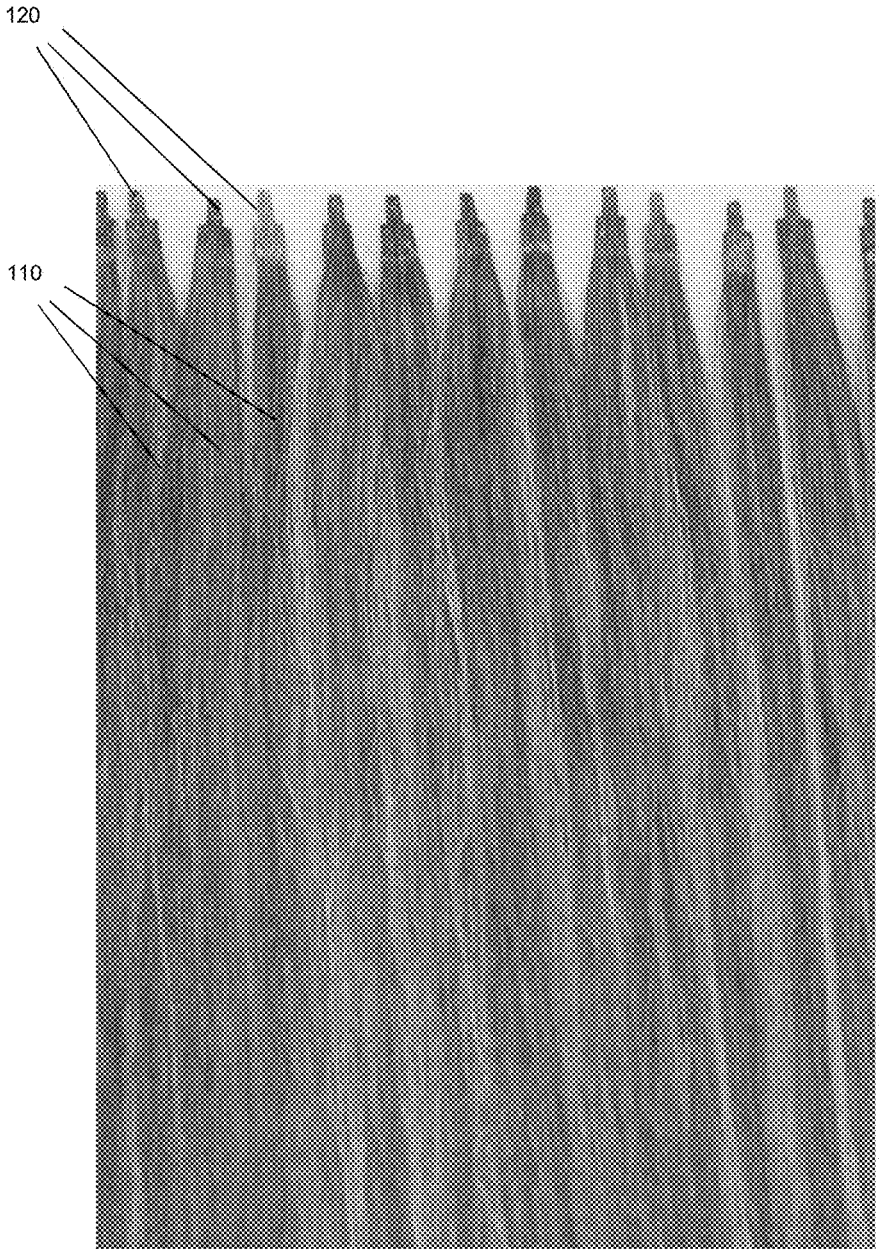
FIG. 3 depicts the hair extensions of FIG. 2, viewed from the opposite side.

However, as shown in FIG. 3, the lighter coloured extensions may be turned over. These hair extensions 100 are darker coloured on the side that is shown facing upwards in FIG. 3. This provides a darker and more even colour effect, across the width of the adjacent hair extensions 100.

Figure 4:
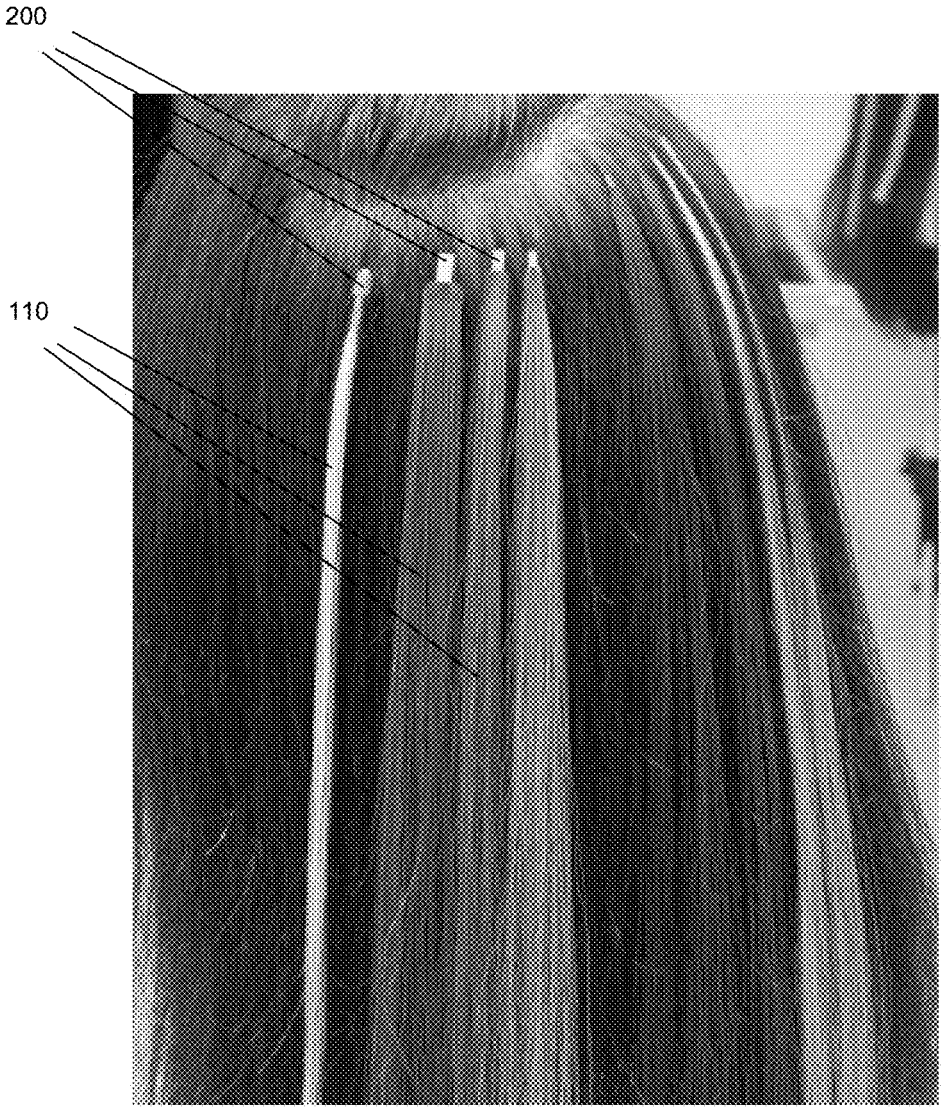
FIG. 4 depicts hair extensions according to an embodiment of the present invention, attached to a person's hair.

FIG. 4 depicts several hair extensions, according to an embodiment of the present invention, attached to a person's natural hair by micro rings 200. It will be noted, as best seen in FIG. 1, that these micro rings 200 have a flat, elongate or oval-shaped cross section, rather than having the circular cross section that is typical of conventional micro rings.

This means that the micro rings 200 themselves, according to the present invention, are also able to lay flatter against the person's scalp, which may help to make them less easily noticed and more comfortable for the subject.

In the embodiment depicted in the figures, the tip section 120 of each hair extension 100 is similarly flat, to generally match the shape of these micro rings 200 and assist the micro rings 200 to be placed close to the scalp, and the body 110 of the hair extension 100 to also lay flat.

Of course, it will be appreciated that micro rings of different shapes may be used to fasten hair extensions according to the present invention—including conventional micro rings with a substantially circular cross section.

Figure 5:
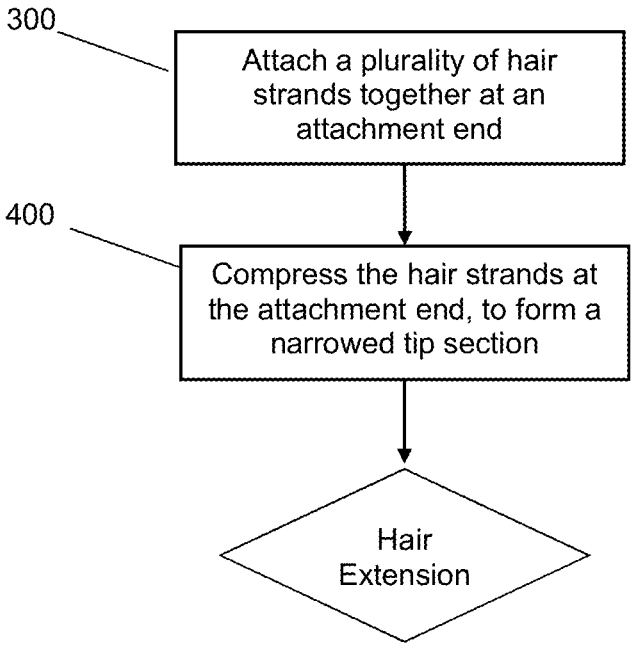
FIG. 5 is a flow chart depicting a method of forming a hair extension according to an embodiment of the present invention.

Referring now to FIG. 5, a method of forming these hair extensions will be described according to an embodiment of the invention.

First, a plurality of hair strands are arranged in a substantially planar (i.e. flat) configuration, and attached together at an attachment end 300. Typically, these are adhered together using glue. Various different types of glue may be used, but preferably it is a soft glue that is applied to the ends of the hair strands as a gel, and is then allowed to dry to a suitable state for the next stage of the process. Depending on the particular glue used, this may take some time—24 hours or more in some cases.

Once the glue is in a suitable state, the attachment end 300 of the extension 100 is compressed to create the tip section 120 of the hair extension 100. This also creates a shoulder 130 on either side of the base of the tip section 120. This is created by bending of the hair strands during the compressing process. Preferably, the tip section 120 and shoulder 130 are formed by bending of the hair strands during the compression step, rather than shearing of the hair strands, as this would weaken the attachment between the hair strands in the hair extension 100.

Figure 6:
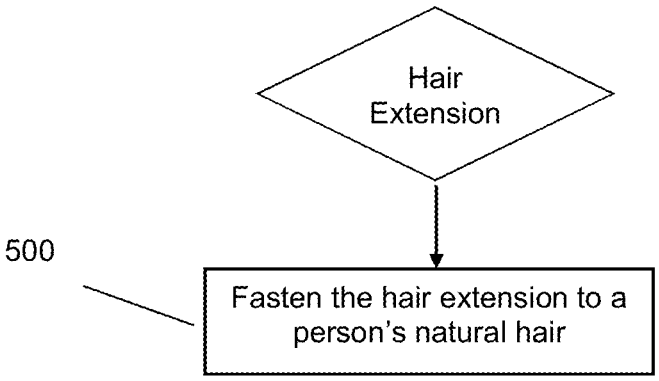
FIG. 6 is a flow chart depicting a method of attaching the hair extension produced in FIG. 6, according to an embodiment of the present invention.
Figure 7:
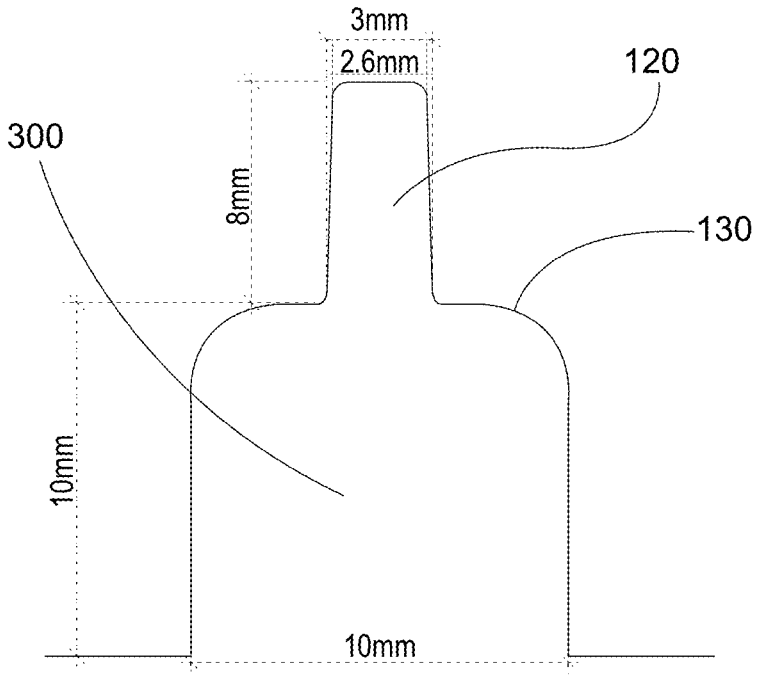
FIG. 7 is a schematic view of the attachment end of a hair extension according to an alternative embodiment of the present invention.

Referring to FIG. 6, once formed, the hair extension 100 may be fastened to a person's natural hair as described above. Of course, this fastening step may be performed a significant time after the hair extension itself is formed, and the fastening step is also likely to be performed by a different entity (e.g. a hair dresser or an end consumer) to those preceding formation steps.

Although an embodiment of the present invention has been described above, various other embodiments that would be apparent to a skilled person are encompassed within the scope of the present invention. In particular, FIGS. 7 to 10 show examples of some modifications to the embodiment of FIGS. 1 to 4.

Figure 8:
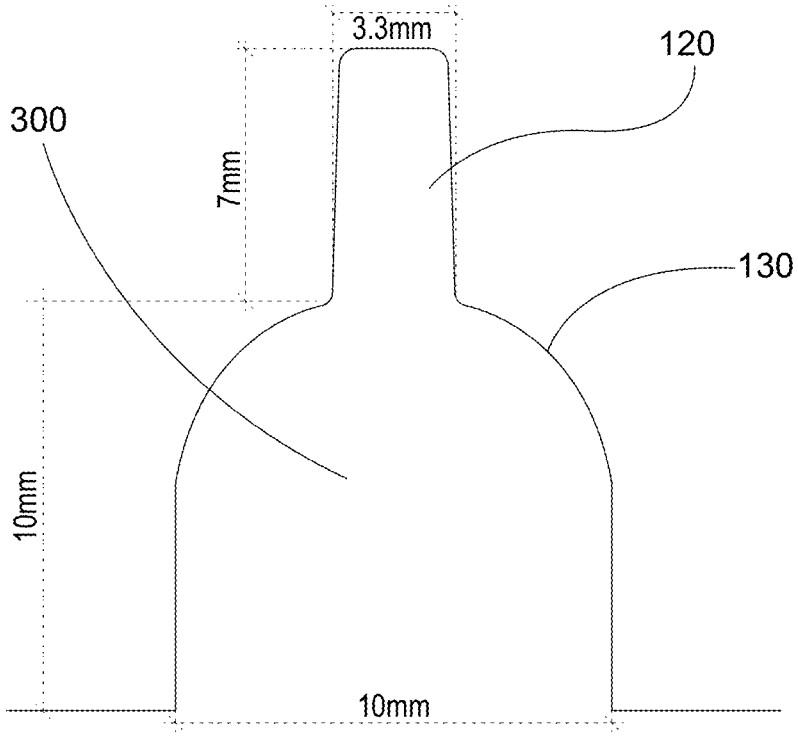
FIG. 8 is a schematic view of the attachment end of a hair extension according to yet another embodiment of the present invention.
Figure 9:
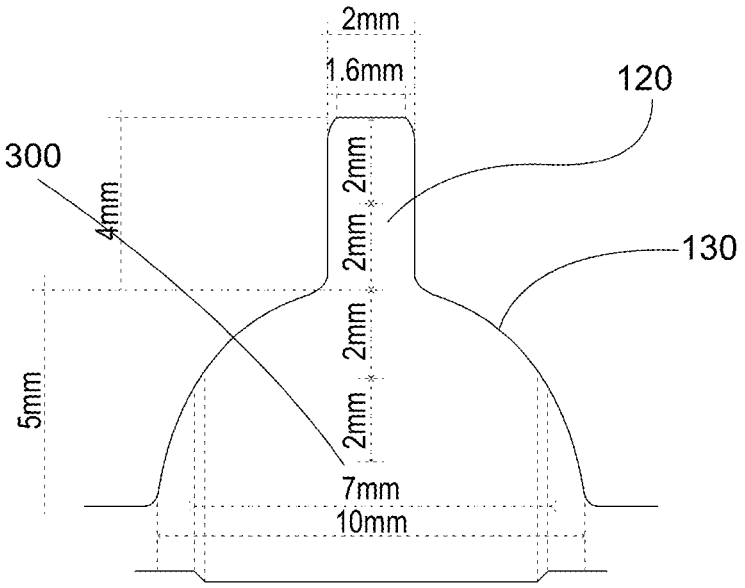
FIG. 9 is a schematic view of the attachment end of a hair extension according to yet another embodiment of the present invention.
Figure 10:
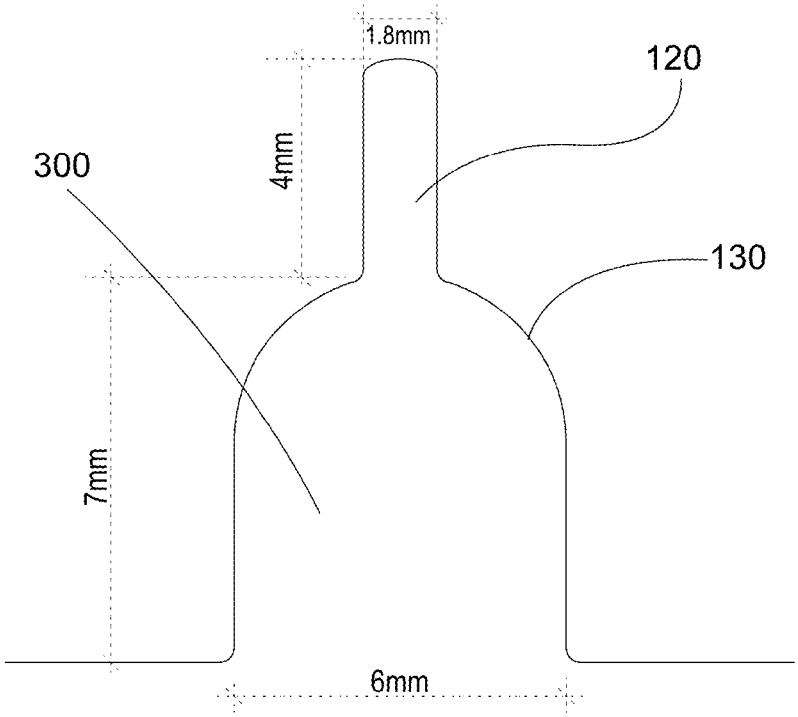
FIG. 10 is a schematic view of the attachment end of a hair extension according to yet another embodiment of the present invention.

In particular, as will be apparent from FIGS. 7 to 10, the gradient of the shoulder 130 from the base of the adhered tip section 120 to the adhered body of the attachment end 300 may vary significantly. The shoulder 130 may be sharp, as depicted in FIGS. 1 to 4, or curved and more gradual as shown in FIGS. 8 to 10.

Other variations will also be apparent. For instance, the size of the micro rings 200 may be varied as shown in FIG. 1. The width of the tip section 120 may vary similarly. This allows smaller micro rings 200 to be used, making them less obtrusive, although of course smaller micro rings 200 may require more skill when using them to fasten hair extensions to a subject's hair.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

In this specification where a document, act or item of knowledge is referred to or discussed, this reference or discussion is not an admission that the document, act or item of knowledge or any combination thereof was at the priority date, publicly available, known to the public, part of the common general knowledge, or known to be relevant to an attempt to solve any problem with which this specification is concerned.

What is claimed is:

1. A hair extension comprising:
(a) a plurality of aligned hair strands; and
(b) an attachment end where the aligned hair strands are adhered together,
the attachment end having:
an adhered body section, said adhered body section comprising:
a single narrowed tip section at an end of the attachment end, the tip section for fastening to a person's natural hair, and
a shoulder defined between the tip section and the adhered body section,
wherein the tip section, the body section and the shoulder are each formed from hair strands adhered together, and
wherein the hair strands of the hair extension including the hair strands in the attachment end have a substantially flat configuration, to define a pair of opposed sides of the hair extension.

2. The hair extension as claimed in claim 1, wherein the ratio of the width of the adhered body section to the width of the narrowed tip section is about 3:1.

3. The hair extension as claimed in claim 1, wherein the width of the adhered body section is about 10 mm and the width of the narrowed tip section is about 3 mm.

4. The hair extension as claimed in claim 1, wherein a colour of one of the pair of opposed sides of the hair extension differs from a colour of the other of the pair of opposed sides of the hair extension.

5. A method for extending a person's hair comprising the steps of:
(a) inserting a section of a person's natural hair and a single narrowed tip section formed from hair strands of a hair extension into a deformable member; wherein the hair extension comprises:
(i) a plurality of aligned hair strands, and
(ii) an attachment end where the aligned hair strands are adhered together, the attachment end comprising:
an adhered body section, said adhered body section comprising:
a single narrowed tip section at an end of the attachment end, the tip section for fastening to a person's natural hair, and
a shoulder defined between the tip section and the adhered body section,
wherein the tip section, the body section and the shoulder are each formed from hair strands adhered together, and
wherein the hair strands of the hair extension including the hair strands in the attachment end have a substantially flat configuration, to define a pair of opposed sides of the hair extension; and
(b) deforming the deformable member to clamp the tip section of the hair extension to the section of the person's natural hair.

6. The method as claimed in claim 5, wherein the deformable member comprises a micro ring having a substantially flat cross section such that, in use, the micro ring lays substantially flat against the person's scalp.

7. A kit for use in extending a person's hair, comprising:
(a) at least one hair extension; wherein the hair extension comprises:
(i) a plurality of aligned hair strands, and
(ii) an attachment end where the aligned hair strands are adhered together,
the attachment end having:
an adhered body section, said adhered body section comprising:
a single narrowed tip section at an end of the attachment end, the tip section for fastening to a person's natural hair, and
a shoulder defined between the tip section and the adhered body section,
wherein the adhered body section, the tip section, and the shoulder are each formed from hair strands adhered together, and
wherein the hair strands of the hair extension including the hair strands in the attachment end have a substantially flat configuration, to define a pair of opposed sides of the hair extension; and
(b) at least one deformable member for fastening the hair extension to the person's hair.

8. The kit as claimed in claim 7, wherein the deformable member comprises a micro ring having a substantially flat cross section such that, in use, the micro ring lays substantially flat against the person's scalp.

* * * * *